US006652359B2

(12) United States Patent
Alberdi et al.

(10) Patent No.: US 6,652,359 B2
(45) Date of Patent: Nov. 25, 2003

(54) FLAT SURFACE GRINDING MACHINE WITH A SECOND WHEELHEAD FOR MACHINING BROACHES

(75) Inventors: Raul Alberdi, Elgoibar (ES); Salvador Aznal, Elgoibar (ES); Alejandro Arrieta, Elgoibar (ES)

(73) Assignee: Danobat, S. Coop., Elgoibar (ES)

( * ) Notice: Subject to any disclaimer, the term of this patent is extended or adjusted under 35 U.S.C. 154(b) by 0 days.

(21) Appl. No.: 09/905,813

(22) Filed: Jul. 12, 2001

(65) Prior Publication Data

US 2002/0016133 A1 Feb. 7, 2002

(30) Foreign Application Priority Data

Aug. 2, 2000 (ES) ..... 200002050 U

(51) Int. Cl.[7] ..... B24B 49/00
(52) U.S. Cl. ..... 451/11; 451/65; 451/195
(58) Field of Search ..... 451/11, 65, 149, 451/140, 141, 143, 150, 195, 220

(56) References Cited

U.S. PATENT DOCUMENTS 2,911,767 A * 11/1959 Sielemann ..... 29/39
4,461,121 A * 7/1984 Motzer et al. ..... 451/226
RE34,155 E * 1/1993 Link ..... 82/18
5,323,572 A * 6/1994 Guenin ..... 29/39
6,126,526 A * 10/2000 Herrscher et al. ..... 451/259

FOREIGN PATENT DOCUMENTS

JP 02224970 A * 9/1990
JP 04269158 A * 9/1992

* cited by examiner

*Primary Examiner*—M. Rachuba
(74) *Attorney, Agent, or Firm*—The Kline Law Firm

(57) ABSTRACT

Grinding machine (1) comprising a first wheelhead (4) for machining flat surfaces and a second wheelhead (10) for machining workpieces (3) such as broaches. The first wheelhead (4) is slidably mounted on a vertical column (6) and has a slide (7) on its underside. The second wheelhead (10) is rotatable about its own axis and is slidably mounted on said slide (7). When the first wheelhead (4) is in its working position, the second wheelhead (10) is placed away from the workpiece (3) on the slide (7) in its rest position (A), and, when the second wheelhead (10) is in its working position (B), said second wheelhead (10) is placed next to the workpiece (3), angularly oriented in order to carry out the helical machining.

3 Claims, 2 Drawing Sheets

FLAT SURFACE GRINDING MACHINE WITH A SECOND WHEELHEAD FOR MACHINING BROACHES

TECHNICAL FIELD

The present invention relates to grinding machines and more specifically to flat surface grinding machines and to grinding machines for machining workpieces such as broaches.

PRIOR ART

Grinding machines that have a tangential wheelhead and grind flat surfaces are well known.

Specific sharpening machines for manufacturing broaches of any type are also well known.

U.S. Pat. No. 3,851,563 discloses a machine for machining workpieces such as broaches. The machine has a single wheelhead and enables the wheelhead to be orientated in such a way that the helical grinding of the workpiece can be executed at a given angle.

U.S. Pat. No. 4,461,121 describes a grinding machine with at least three wheels offering the possibility of the relative positioning of the workpiece to be ground and the wheels so as to execute said workpiece in accordance with the specifications that this is to have.

DISCLOSURE OF THE INVENTION

The object of the invention is to provide a flat surface grinding machine that has a second wheelhead for machining workpieces such as broaches, as defined in the claims.

With the machine that is the object of the invention, a conventional flat surface grinding machine may also be used for machining broaches by including for this purpose a second retracting wheelhead rotatable about its own axis.

The advantages that stem from the invention are as follows:

There is no need to build a machine specifically for machining broaches, as the flat surface grinding machine may be used.

A sturdy machine is obtained.

The working of the machine is simple. The transition from machining with the first wheelhead to machining with the second wheelhead and vice versa is done by numeric control by means of the vertical movement of the first wheelhead and the horizontal movement of the second wheelhead in relation to the first wheelhead, no other type of operation, such as the manual replacement of one wheelhead for another, being necessary.

When the second wheelhead is in the rest position the arrangement is such that it does not restrict the travel of the machine.

DETAILED DISCLOSURE OF THE INVENTION

Figure 1:
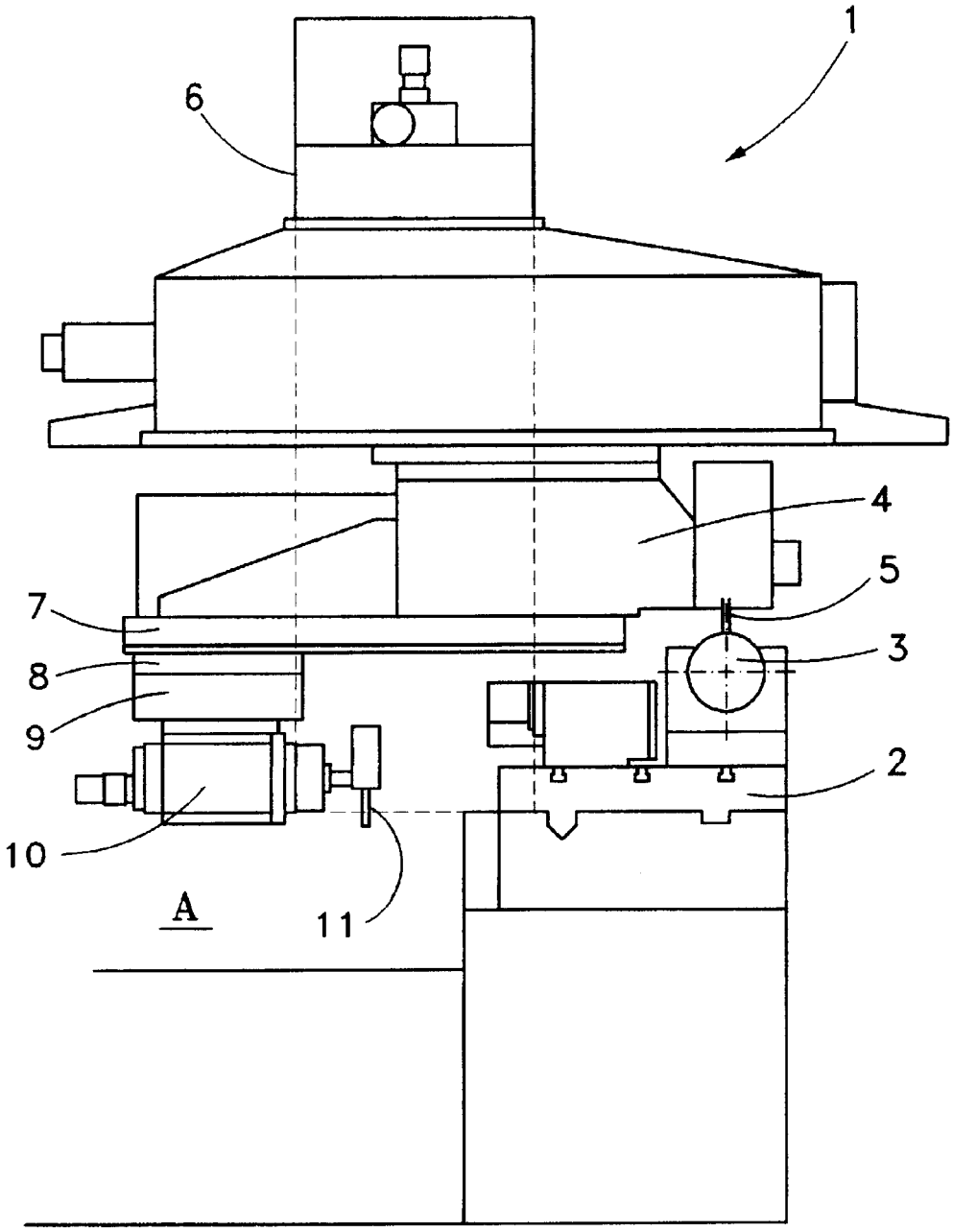
FIG. 1 is an elevational view of the machine of the invention in the position in which the second wheelhead is retracted and the workpiece is being ground with the wheel of the first wheelhead.

With reference to FIG. 1, the grinding machine 1 has a machining table 2 on which the workpiece 3 to be machined is secured. The machine 1 comprises a first wheelhead 4, with its respective wheel 5, with the option of vertical movement in relation to a fixed vertical column 6. The workpiece 3 is situated between a headstock and a tailstock. The headstock allows the workpiece 3 to rotate in respect of its own axis.

On its underside the first wheelhead 4 has a slide 7 with a shifting pedestal 8 that moves on said slide 7. Said shifting pedestal 8 is linked to an index plate 9, which is linked in turn to a second wheelhead 10, with its respective wheel 11. In this way, the wheelhead 10 can slide longitudinally in relation to the main wheelhead 4 and may in turn rotate in respect of its own axis.

Figure 2:
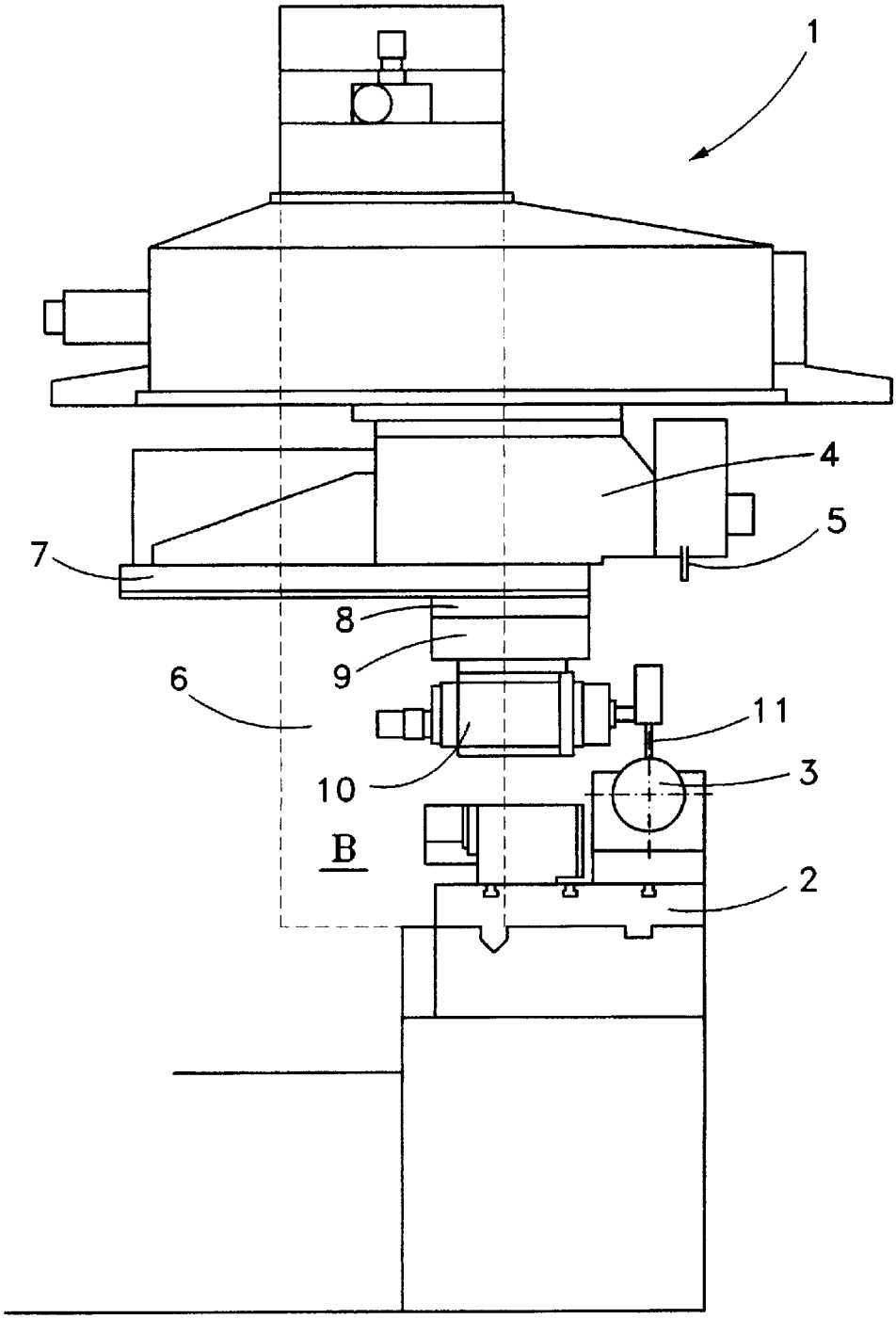
FIG. 2 is an elevational view of the machine of the invention in the position in which the workpiece is being machined with the wheel of the second wheelhead.

In FIG. 1 the wheelhead 10 is in its rest position (position A) and it is the wheel 5 that is grinding. In FIG. 2 said wheelhead 10 is in its working position (position B), while the wheel 11 is being used. To pass from the position of FIG. 1 to the position of FIG. 2, the first wheelhead 4 moves according to the vertical axis on column 6. The shifting pedestal 8 then moves on the slide 7 until the wheelhead 10 reaches its working position on the workpiece 3. The horizontal movement of the wheelhead 10 and the horizontal movement of the workpiece 3 are perpendicular.

The index plate 9 enables the wheelhead 10 to turn in respect of its own axis, whereby the wheel 11 can attack the workpiece 3 at a certain angle set at the numeric control. In this way, the helical grinding of the workpiece 3 is carried out by combining the movement of said workpiece 3 in respect of said wheel 11 with the simultaneous rotation of the workpiece 3 in respect of its own axis. The workpiece 3 is rotated by way of the headstock to which said workpiece 3 is attached, the speed of the aforesaid rotation being governed by numeric control.

What is claimed is:

1. A grinding machine for machining flat surfaces and workpieces such as broaches comprising:

means for horizontally displacing a workpiece to be machined and means for rotating said workpiece, a vertical column, a first wheelhead slidably mounted on said vertical column, said first wheelhead having a slide on an underside thereof, and a second wheelhead slidably mounted on said slide on said underside of said first wheelhead so that said second wheelhead moves horizontally with respect to said first wheelhead;

wherein when said first wheelhead is in a first working position, said second wheelhead is placed away from said workpiece on said slide in a rest position, and, when said second wheelhead is moved to a second working position next to said workpiece, said second wheelhead being angularly oriented in order to carry out helical machining, movement of said second wheelhead back and forth between said rest position to said second working position being accomplished by vertical movement of said first wheelhead and horizontal movement of said second wheelhead.

2. The grinding machine according to claim 1, wherein:

said second wheelhead is mounted on said slide by means of an index plate and a shifting pedestal.

3. The grinding machine according to claim 1, wherein:

horizontal movement of said workpiece and horizontal movement of said second wheelhead are perpendicular.

* * * * *